United States Patent [19]

Rymas

[11] 4,308,059

[45] Dec. 29, 1981

[54] CAPILLARY

[75] Inventor: Frank Rymas, Sterling Hts., Mich.

[73] Assignee: GTE Products Corporation, Stamford, Conn.

[21] Appl. No.: 52,878

[22] Filed: Jun. 28, 1979

[51] Int. Cl.[3] ..... B22F 7/00; C22C 29/00

[52] U.S. Cl. ..... 75/240; 75/236

[58] Field of Search ..... 75/240, 236

[56] References Cited

U.S. PATENT DOCUMENTS 2,097,140 10/1937 Wohrman ..... 75/240

3,600,334 8/1971 Koncz ..... 75/240

*Primary Examiner*—Brooks H. Hunt

*Attorney, Agent, or Firm*—Robert E. Walter

[57] ABSTRACT

A refractory body having acid resistant properties consists of a metal carbide dispersed throughout a metal matrix of ruthenium or alloy thereof. An elongated member of the above composition having an opening therein is used as a guide for precious metal wire.

5 Claims, 3 Drawing Figures

CAPILLARY

BACKGROUND OF THE INVENTION

The present invention relates to corrosion resistant refractory bodies and more specifically to cemented metal carbide bodies that are resistant to acids.

For certain applications, it is desirable that refractory parts be resistant to a corrosive environment and, in particular, be able to withstand the attack of acids. In one such case, it is common to handle valuable metal such as silver, gold, or platinum in the form of wires for various applications in the electronics industry. Refractory bodies having a hole therein larger than the size of the wire are typically used for guiding the wire.

In use, the capillaries are subject to a gradual buildup of precious metal residue which can interfere with the proper feeding of the precious metal wire and, thus, it is necessary to regularly clean or replace the capillary. A typical method of cleaning the capillary is by brushing or using an abrasive compound to remove the build-up deposits.

SUMMARY OF THE INVENTION

It is desirable that a capillary have high hardness and abrasion resistance, and high strength to be suitable for guiding wires.

In accordance with the present invention, there is provided a refractory body having high hardness, high mechanical strength and, in addition acid resistant properties wherein the body consists essentially of a metal carbide dispersed throughout a matrix of ruthenium or alloy thereof, wherein the matrix is present in an amount sufficient to impart acid resistant properties to the refractory body.

When the refractory body of the present invention is used as a capillary, precious metal residue such as gold may be removed therefrom by immersion of the capillary in an acid bath, such as aqua regia, which easily dissolves gold.

Heretofore, this method of removing precious metal deposits could not be readily used since capillaries formed from tungsten carbide in a cobalt matrix or titanium carbide in a nickel matrix are readily attacked by acids. Although other materials, such as aluminum oxide may possess the necessary acid resistance, the requisite high mechanical strength needed for the above application is not present therein.

Further, in accordance with the present invention, there is provided a guide for wire comprising an elongated member having an opening therein, said guide having high hardness, high mechanical strength and acid resistant properties and consisting essentially of a metal carbide dispersed throughout a matrix of ruthenium or alloy thereof, wherein said matrix is present in an amount sufficient to impart acid resistant properties to said refractory body.

DETAILED DESCRIPTION OF THE PREFERRED EMBODIMENTS

The refractory body of the present invention consists essentially of metal carbide dispersed throughout a matrix. Typical metal carbides are the carbides of tungsten, molybdenum, chromium, columbium, tantalum, titanium, zirconium, vanadium and hafnium. Preferably the starting powder or grains of metal carbide used have a mesh size less than 200 mesh, U.S. standard screen size. This generally results in particle sizes less than about 10 microns. The metal carbide may be sized by crushing to the proper size in a ball mill or by other conventional methods. Relatively larger grain sizes may be employed but will necessarily require higher forming pressures and higher temperatures for satisfactory densification.

The matrix materials are preferably ruthenium and alloys thereof. Typical metals that may be alloyed with ruthenium include platinum, iridium, osmium, rhodium, cobalt, nickel and iron which may be present in an amount to the extent that the beneficial acid resistant properties of ruthenium are not altered. To impart the desirable acid resistant properties to the final refractory body, it is preferably that the refractory body consist greater than about 5 percent by weight ruthenium. The amount of additional metals alloyed with ruthenium is preferably less than about 20 percent by weight based on the weight percent of ruthenium present. The balance of the refractory body composition consists essentially of the metal carbide together with incidental impurities and residuals present in convential amounts. Such normal residuals and incidental impurities can be tolerated in quantities which do not adversely affect the high hardness, high strength and acid resistant properties of the reporting body.

Due to the high affinity ruthenium metal has for sintering with tungsten carbide at reasonable temperatures, tungsten carbide is the preferred metal carbide. With a refractory body consisting essentially of tungsten carbide particles dispersed in a matrix material of ruthenium metal, it is preferred that ruthenium be present in an amount from about 5 percent to about 15 percent of the total weight of the final refractory body. To be suitable for use as a capillary, it is preferable that the refractory body has a hardness greater than about 90 on the Rockwell scale. Preferably the transverse rupture strength in pounds per square inch is greater than about 200,000.

Figure 1:
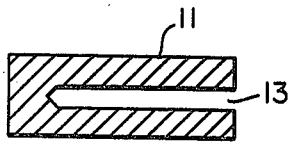
FIG. 1 is a side elevational view in section of a capillary after hot pressing.
Figure 2:
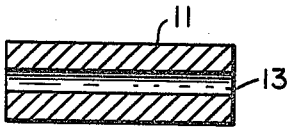
FIG. 2 is a side elevational view in section of the capillary in FIG. 1 after machining.
Figure 3:
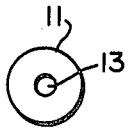
FIG. 3 is an end elevational view of the refractory body of FIG. 2.

FIG. 1 illustrates a capillary blank 11 having an elongated cylindrical shape. Hole 13 in the cylindrical body 11 is axially aligned. An inner portion of hole 13 is tapered to a point spaced from the closed end of the body 11. To accommodate wires typically used in electronics industry, the refractory body 11 is generally about $\frac{5}{8}$ of an inch long with an external diameter of about $\frac{1}{8}$ of an inch and an internal diameter of about 1/16 of an inch. FIG. 2 illustrates the refractory body of FIG. 1 with the closed end machine so that hole 13 extends therethrough for accommodating and guiding a wire.

In preparing the refractory bodies of the present invention, the metal carbide powder is mixed with ruthenium metal powder and the final powder mixture is introduced into a rigid mold cavity. According to methods commonly employed in the art, the mold cavity is equipped with the pressure applying means. The pressure may be applied by a variety of means. However, hydraulic or pneumatic pressure means are usually preferred because of adjustability and ease of control. The mold cavity may be equipped with a heating means as well-known in the art such as an electrical resistant furnace or high frequency induction furnace. The pressure from the ram and the heat from the furnace may be simultaneously applied so as to form a refractory body. It is most preferable to form the refractory body 11 by pressing and sintering in separate steps. The pressing may be carried out from about 5,000 to about 30,000 pounds per square inch and the sintering at a temperature from 1550° C. to about 1850° C. under a vacuum. After sintering the refractory body is machined to a final configuration.

EXAMPLE

Tungsten carbide in the form of grained powder having a particle size of about 5 microns is mixed with ruthenium metal powder having a particle size of 5 microns in a dry blender to form a mixture comprising about 10 parts by weight ruthenium metal. A portion of the mixture is placed in a die and the powder is pressed at a pressure of about 15,000 pounds per square inch. Subsequent sintering step is at a temperature of about 1650° C. for 90 minutes. The resulting refractory body has a strength of about 250,000 psi and a hardness of about 94 Rockwell. The refractory body having a configuration as illustrated in FIG. 1 was ground at the closed end to the location where the hole extended entirely throught the body. The resulting capillary was used to guide gold wire for forming gold dots on electrical contacts. After a period of use in this environment, a residual build-up of gold was observed on the capillary. The capillary was immersed in a solution of hydrochloric acid and nitric acid for approximately three minutes. The capillary was removed, washed and visibly observed. There was no visible trace of gold and no apparent damage to the capillary was observed due to the acid immersion.

The particular embodiments of the present invention being described, it is obvious to one of the ordinary skill in the art to make various modifications and changes without departing from the spirit and scope of the present invention.

I claim:

1. A guide for a wire comprising an elongated member having an opening therein, and consisting essentially of a metal carbide dispersed throughout a metal matrix of ruthenium or alloy of ruthenium and additional metal, said ruthenium being present in an amount from about 5 to about 15 percent of the total weight of said refractory body, and said additional metal being present in an amount less than about 20 percent by weight based on the weight percent of ruthenium present, wherein said matrix is present in an amount sufficient to impart acid resistant properties to said refractory body.

2. A guide for a wire according to claim 1 wherein said metal carbide comprises a carbide of tungsten.

3. A guide for a wire according to claim 2 wherein said body consists essentially of a carbide of tungsten dispersed in a matrix of ruthenium metal.

4. A guide for a wire according to claim 2 wherein said body consists of from about 5 percent to about 15 percent by weight ruthenium metal and the remaining percent by weight metal carbide.

5. A guide for a wire according to claim 4 wherein said body consists of from about 8 to about 12 percent by weight ruthenium metal and the remaining percent by weight metal carbide.

* * * * *